US006564483B1

(12) United States Patent
Hsu

(10) Patent No.: US 6,564,483 B1
(45) Date of Patent: May 20, 2003

(54) WATER BALL DECORATIONS

(76) Inventor: Shun-Hsi Hsu, No. 17, Lane 99, Pei-Yuan Street, Tainan (TW)

( * ) Notice: Subject to any disclaimer, the term of this patent is extended or adjusted under 35 U.S.C. 154(b) by 0 days.

(21) Appl. No.: 10/090,830

(22) Filed: Mar. 6, 2002

(51) Int. Cl.[7] ..... G09F 19/00
(52) U.S. Cl. ..... 40/409; 40/410
(58) Field of Search ..... 40/409, 410, 406, 40/411, 414; 446/267

(56) References Cited

U.S. PATENT DOCUMENTS 5,967,088 A * 10/1999 Lin ..... 40/406
5,971,831 A * 10/1999 Hsu ..... 40/406
6,061,937 A * 5/2000 Meng ..... 40/409
6,241,255 B1 * 6/2001 Fang ..... 40/410

* cited by examiner

*Primary Examiner*—Gary Hoge
(74) *Attorney, Agent, or Firm*—Rosenberg, Klein & Lee

(57) ABSTRACT

A water ball decoration includes a plug, which has an annular outer wall fitted into a lower end neck-shaped opening of a water-containing ball-shaped part, and an annular inner wall within the outer wall; a bottom is connected to the lower end of the inner wall to define a containing room. The annular inner wall is provided with corrugated surfaces on both the inner and the outer sides which will reduce the effect of the pressure of the inside of the ball part on the outer wall of the plug provided for tight connection with the opening. A hollow cone-shaped part is fitted into the containing room with an upper wider portion thereof being connected to the upper end of the inner wall; a space is provided between the narrower end opening and the bottom of the plug; thus air bubbles can be confined in a space between the outer side of the cone-shaped part and the inner side of the inner wall by means of turning the ball decoration upside down slowly and moving same back to the original position.

7 Claims, 4 Drawing Sheets

WATER BALL DECORATIONS

BACKGROUND OF THE INVENTION

The present invention relates to a water ball decoration, more particularly a water ball decoration, which is provided with an anti-leakage rubber plug capable of effectively preventing liquid from leaking out of the ball-shaped part, and such a structure that air bubbles can be easily removed from the ball-shaped part to not affect the appearance of the water ball decoration for the worse.

Referring to FIG. 1, a conventional water ball decoration includes a glass ball-shaped part 20, a decoration 30, a base 10, and an anti-leakage rubber plug 40. The glass ball 20 has a lower end opening, which is defined by hollow neck-shaped part. Water is contained in the ball-shaped part 20, and the decoration 30 is secured to the rubber plug 40. The anti-leakage rubber plug 40 is tightly fitted into the neck-shaped part of the water ball 20 to prevent the water in the ball from leaking out when the ball-shaped part 20, in which the decoration 30 is disposed, is held on the base 10 with the neck-shaped opening being at the lowermost position. To reinforce the anti-leak function of the rubber plug 40, the neck-shaped part is formed with an annular concave 201 on the inner side, and the rubber plug 40 is formed with an annular curved projection 401 on the outer side such that tightness of the contact between both can be increased.

However, it is found that the water ball decoration has disadvantages as followings:

1. Should air be left in the water ball in assembly or flow into same due to leakage of the rubber plug so as to cause air bubbles to be formed, the appearance of the water ball decoration is badly affected, making the water ball decoration become a failure.

2. Although the tube-shaped opening, and the rubber plug are respectively provided with the annular concave and the annular curved projection, water leakage can still happen because the pressure inside the ball-shaped part is likely to be greater than the force of the connection of the plug to the opening to cause gaps to be formed between the plug and the neck-shaped opening.

SUMMARY OF THE INVENTION

Therefore, it is a main object of the present invention to provide a water ball decoration, which is provided with a hidden place such that should air bubbles come into existence, the air bubbles can be hidden in the hidden place so as to not show.

And, it is another object of the present invention to provide the water ball decoration with a plug shaped in such a manner as to be able to reduce the effect of the pressure of the inside of the ball-shaped part of the decoration on the plug.

The water ball decoration of the present invention includes a plug, which has an annular outer wall fitted into a lower end neck-shaped opening of a water-containing ball-shaped part of the water ball decoration, and an annular inner wall within the outer wall; a bottom is connected to the lower end of the inner wall to define a containing room. The annular inner wall is provided with corrugated surfaces on the inner, and the outer sides which will reduce the effect of the pressure of the inside of the ball part on the outer wall of the plug provided for tight connection with the opening.

A hollow cone-shaped part is fitted into the containing room with an upper wider portion thereof being connected to the upper end of the inner wall; a space is provided between the narrower end opening and the bottom of the plug; thus air bubbles can be confined in a space between the outer side of the cone-shaped part and the inner side of the inner wall by means of turning the ball decoration upside down slowly and moving same back to the original position.

BRIEF DESCRIPTION OF THE DRAWINGS

This invention will be better understood by referring to the accompanying drawings, wherein.

DETAILED DESCRIPTION OF THE PREFERRED EMBODIMENTS

Figure 1:
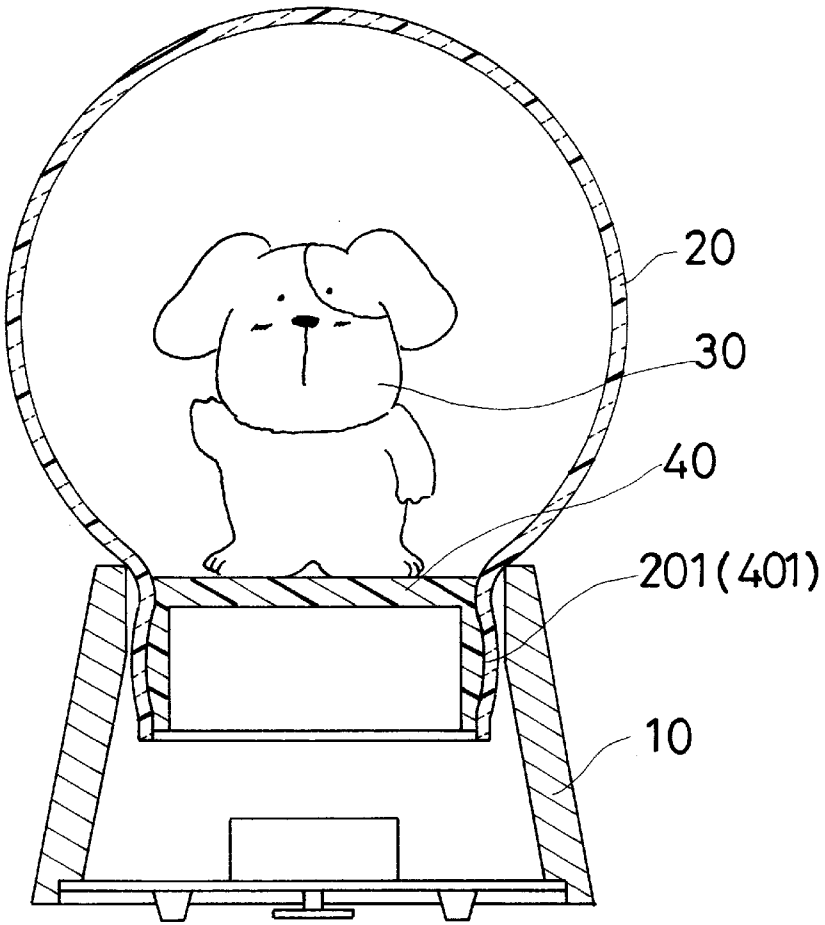
FIG. 1 (PRIOR ART)
FIG. 1 is a plan view of the conventional water ball decoration in the background.
Figure 7:
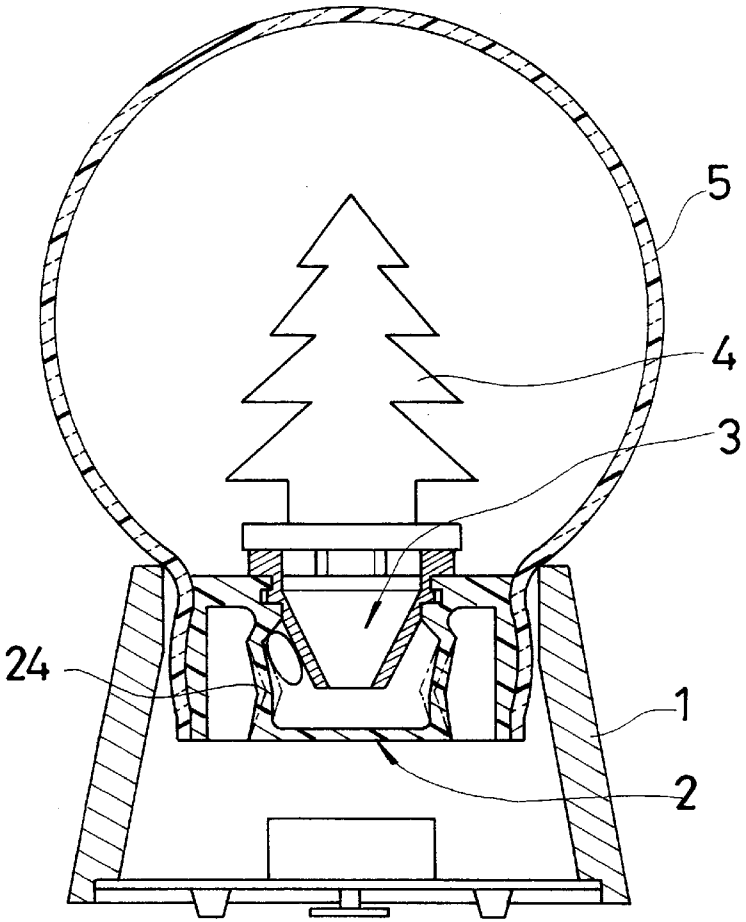
FIG. 7 is a view showing the inner wall of the plug with corrugated surfaces being absorbing the pressure of the inside of the ball-shaped part.
Figure 2:
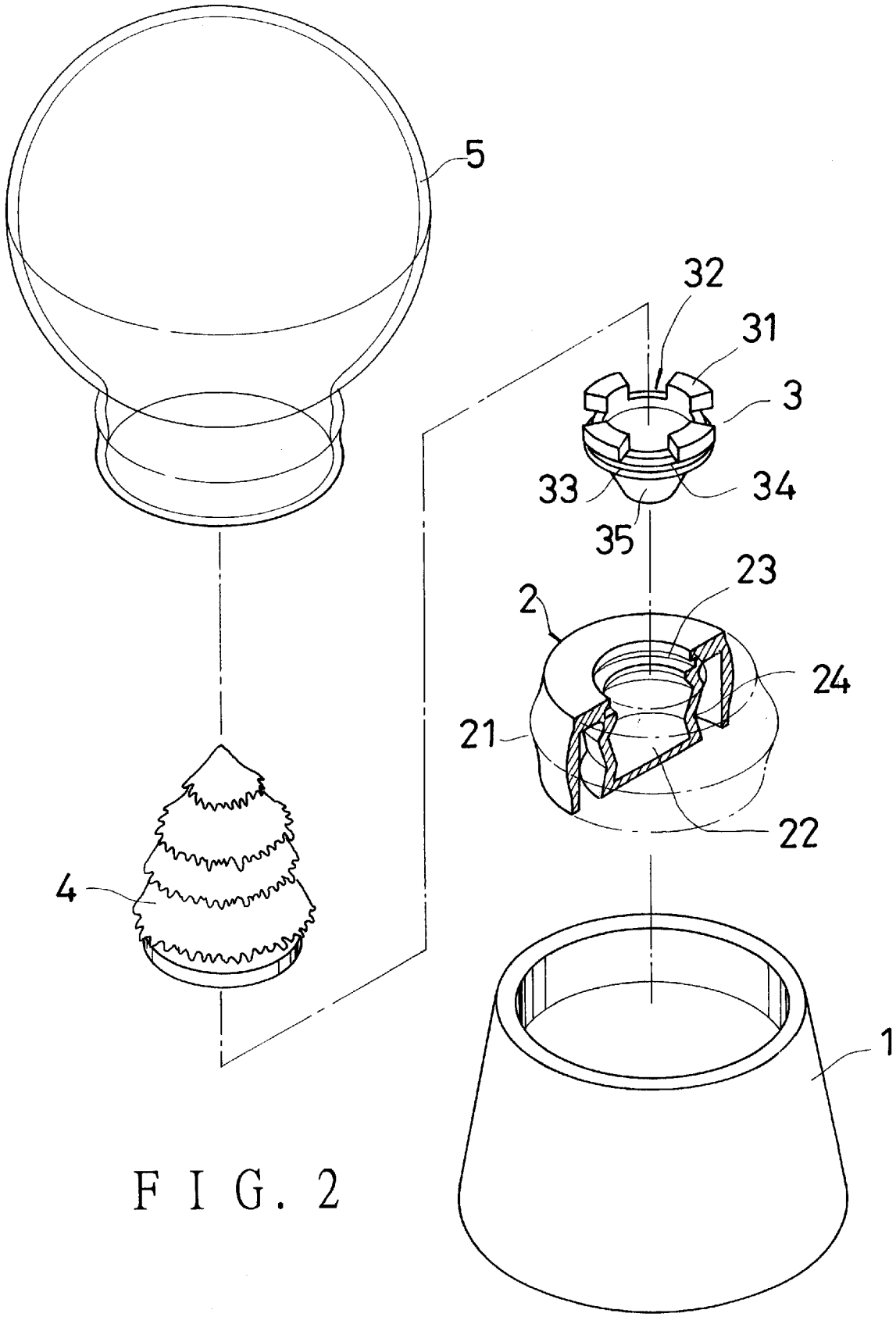
FIG. 2 is an exploded perspective view of the water ball decoration of the present invention.
Figure 3:
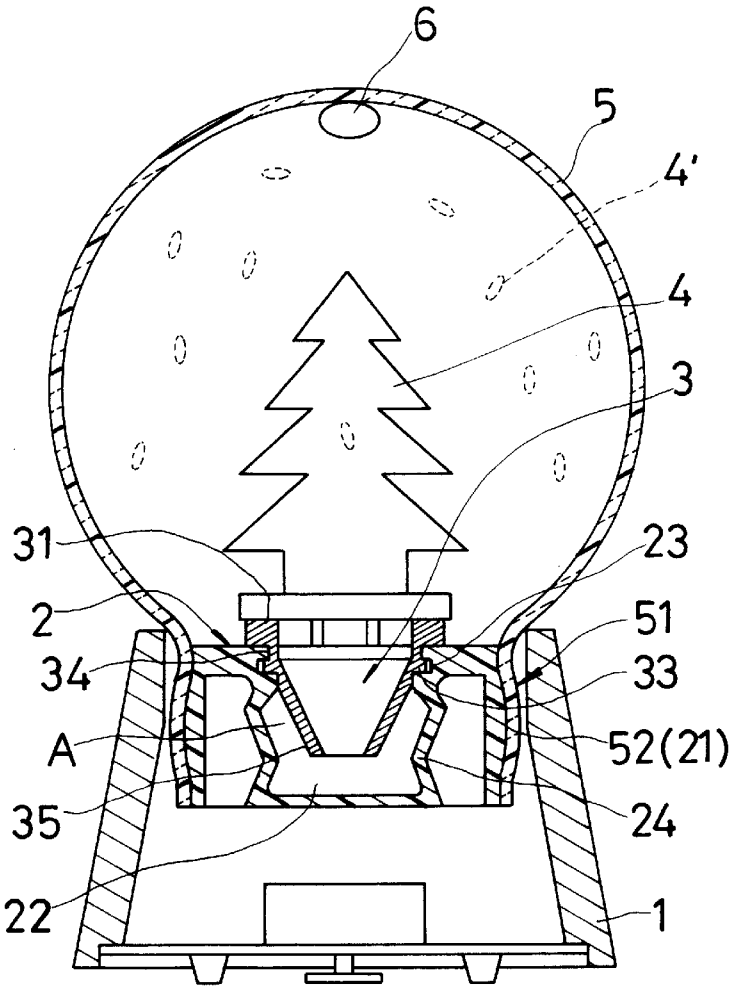
FIG. 3 is a plan view of the water ball decoration of the present invention.

Referring to FIGS. 2 and 3, a water ball decoration of the present invention includes a base 1, an anti-leakage rubber plug 2, a hollow cone-shaped member 3, a decorating object 4, and a glass ball-shaped part 5 having a lower end opening; the lower end opening of the ball-shaped part 5 is shaped like a neck. The rubber plug 2 is fitted into the opening of the ball-shaped part 5 from an outer wall to prevent water contained in the ball-shaped part 5 from leaking out of same; the lower end opening of the ball-shaped part 5 further has an annular concave 52 on an inner side, and the anti-leakage plug 2 has an annular curved projection 21 on an outer side of the outer wall thereof to fit into the annular concave 52.

The ball-shaped part 5 is disposed on the base 1, and the decorating object 4 is disposed in the ball-shaped part 5. In addition, a plurality of glittery sparkling sheet member 4' may be received in said ball-shaped part 5 to make the water ball decoration more attractive. For clarity, these optional sparkling sheet members are illustrated only in FIG. 3 (in broken lines).

The anti-leakage rubber plug 2 is further provided with a middle containing room defined by both an inner annular wall 24 and a bottom (not numbered) thereof; the bottom is tightly connected to a lower end of the inner wall 24; corrugated surfaces are formed on both an inner and an outer sides of the inner annular wall 24 of the anti-leakage rubber plug 2 for reducing an effect of pressure of the water contained in the ball-shaped part 5 on the watertight connection of the plug 2 to the opening of the ball-shaped part 5.

The hollow cone-shaped member 3 is fitted into the containing room 22 of the plug 2 with an upper wider portion being tightly connected to an upper portion of the inner wall 24 of the plug 2 and with a lower narrower end opening being a distance away from the bottom of the plug 2, thus forming a hiding space (A) between an outer side thereof and an inner side of the inner annular wall 24 of the plug 2 for allowing air bubbles to be hidden therein. Furthermore, the inner wall 24 around the containing room 22 is provided with an annular trench 23 at an upper portion of an inner side thereof, and the cone-shaped member 3 is provided with an annular projection 33 at an upper portion of an outer side to be fitted onto the annular trench 23. And, the hollow cone-shaped member 3 is provided with several separate blocks 31 alongside an upper end thereof such that air bubbles are allowed to flow through the upper end thereof into the hiding place (A) when the decorating object 4 is secured on the blocks 31. An annular trench 34 is formed between the annular projection 33 and the blocks 31 of the cone-shaped member 3 to fit onto the annular upper end of the inner wall 24 that is just above the trench 23.

Figure 4:
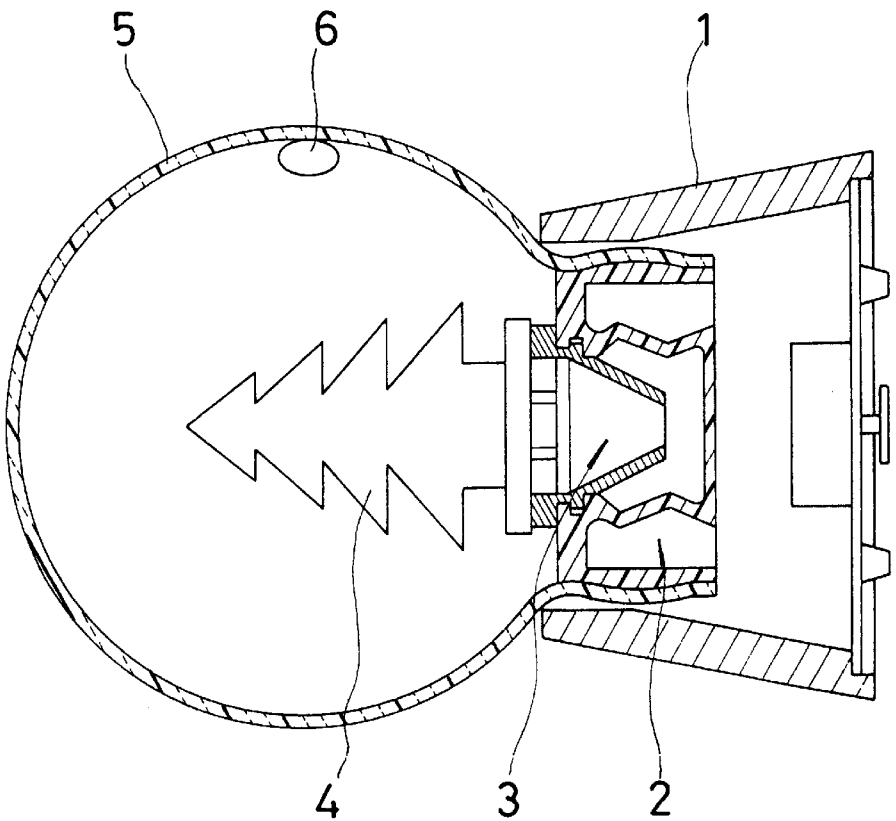
FIG. 4 is a view showing the way of moving air bubbles to the hiding place according to the present invention.
Figure 6:
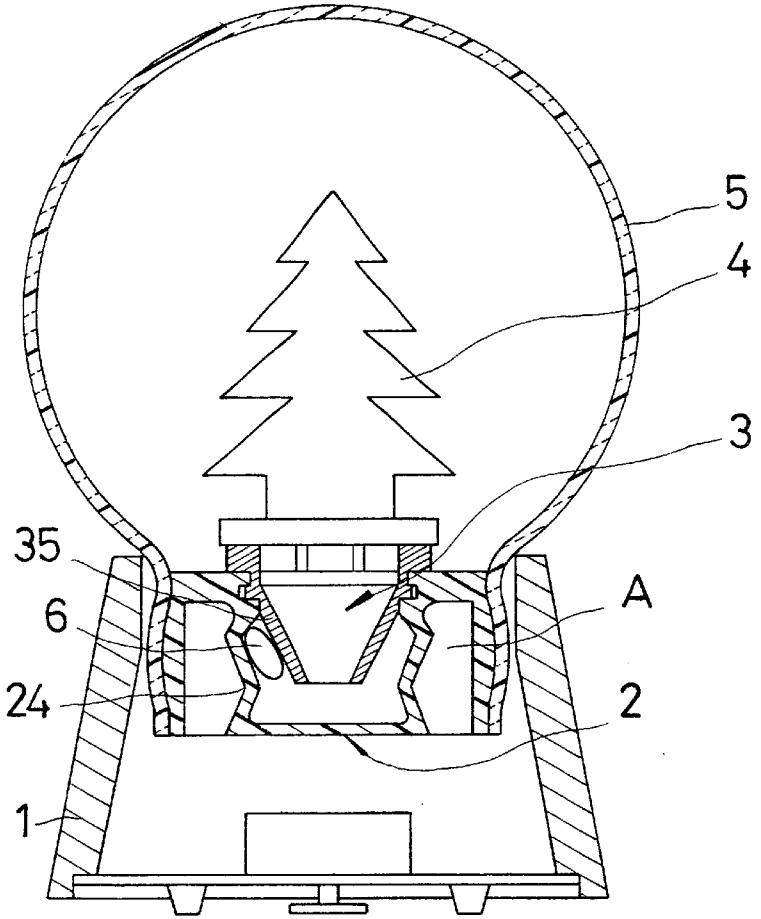
FIG. 6 is a third view showing the way of moving air bubbles to the hiding place according to the present invention.
Figure 5:
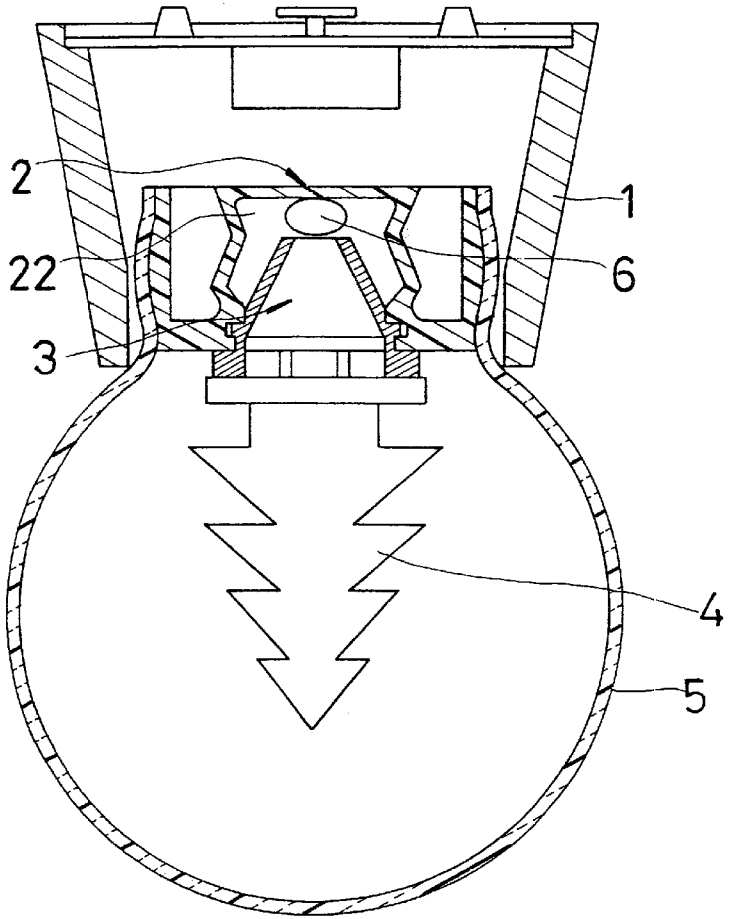
FIG. 5 is a second view showing the way of moving air bubbles to the hiding place according to the present invention.

Should air bubbles 6 come into existence in the ball-shaped part 5 as shown in FIG. 3, referring to FIGS. 4, 5 and 6, the user can turn the water ball decoration slowly to an upside down position for the air bubbles 6 to move through the cone-shaped member 3 to the narrower end opening, and then move the ball decoration back to the original position such that the air bubbles 6 are confined in the hiding place (A) to not show.

From the above description, it can be easily understood that the water ball decoration of the present invention has advantages as followings:

1. The inner annular wall 24 with the corrugated surfaces can reduce the effect of pressure inside the ball-shaped part 5 on the outer wall of the anti-leakage plug 2, thus reinforcing the anti-leakage function of the plug 2.

2. The hiding place (A) allows air bubbles to be received therein to not show to badly affect the look of the water ball decoration, preventing air bubbles from making the product become a failure.

What is claimed is:

1. An improvement of a water ball decoration;

said water ball decoration including a base, an anti-leakage rubber plug, and a glass ball-shaped part having a lower end opening; said rubber plug being fitted into said opening of said ball-shaped part from an outer wall to prevent water contained in said ball-shaped part from leaking out of same; said ball-shaped part being disposed on said base and provided with a decorating object disposed therein;

said plug being provided with a middle containing room defined by both an inner annular wall and a bottom thereof tightly connected to a lower end of said inner wall; said improvement including corrugated surfaces formed on both an inner and an outer side of said inner annular wall of said plug for reducing an effect of pressure of said water on a connection of said plug with said opening of said ball-shaped part.

2. The improvement of the water ball decoration of claim 1 further comprising a cone-shaped member; said cone-shaped member being fitted into said containing room of said plug with an upper wider portion being tightly connected to an upper portion of said inner wall of said plug and with a lower narrower end opening being a distance away from said bottom of said plug, thus forming a hiding space between an outer side thereof and an inner side of said inner annular wall of said plug for air bubbles to be hidden therein.

3. The water ball decoration of claim 1 or 2, wherein a plurality of glittery sparkling sheet members are received in said ball-shaped part.

4. The water ball decoration of claim 1 or 2, wherein said lower end opening of said ball-shaped part is shaped like a neck.

5. The water ball decoration of claim 1 or 2, wherein said lower end opening of said ball-shaped part has an annular concave on an inner side, and said plug has an annular curved projection on an outer side of said outer wall to fit into said annular concave.

6. The water ball decoration of claim 2, wherein said inner wall around said containing room is provided with an annular trench at an upper end of an inner side, and said cone-shaped member is provided with an annular projection at an upper portion of an outer side to be fitted onto said annular trench.

7. The water ball decoration of claim 2, wherein said hollow cone-shaped member is provided with a plurality of separate blocks around an upper end thereof for said decorating object to be secured thereon and for allowing air bubbles to flow through said upper end of same into said hiding place.

* * * * *